US010273969B2

(12) United States Patent
Handloser et al.

(10) Patent No.: US 10,273,969 B2
(45) Date of Patent: Apr. 30, 2019

(54) AXIALLY SPLIT PUMP

(71) Applicant: Sulzer Management AG, Winterthur (CH)

(72) Inventors: Willy Handloser, Jestetten (DE); Thomas Welschinger, Radolfzell (DE); Heike Tischler, Winterthur (CH)

(73) Assignee: SULZER MANAGEMENT AG, Winterthur (CH)

( * ) Notice: Subject to any disclaimer, the term of this patent is extended or adjusted under 35 U.S.C. 154(b) by 436 days.

(21) Appl. No.: 14/946,982

(22) Filed: Nov. 20, 2015

(65) Prior Publication Data

US 2016/0160873 A1 Jun. 9, 2016

(30) Foreign Application Priority Data

Dec. 5, 2014 (EP) ..... 14196438

(51) Int. Cl.
*F04D 1/06* (2006.01)
*F04D 17/08* (2006.01)
(Continued)

(52) U.S. Cl.
CPC ..... *F04D 29/126* (2013.01); *F04D 1/06* (2013.01); *F04D 17/08* (2013.01); *F04D 29/043* (2013.01);
(Continued)

(58) Field of Classification Search
CPC .... F04D 29/083; F04D 29/086; F04D 29/122; F04D 29/126; F04D 29/403;
(Continued)

(56) References Cited

U.S. PATENT DOCUMENTS 5,257,835 A * 11/1993 Baumbach ..... A61M 39/16 285/110
9,316,314 B2 * 4/2016 Meuter ..... F16J 15/06
(Continued)

FOREIGN PATENT DOCUMENTS

CN 104040175 A1 9/2014
CN 104081060 A1 10/2014
(Continued)

OTHER PUBLICATIONS

Extended European Search Report dated Jun. 10, 2015 in European Patent Application No. 14196438.7, Filed Dec. 5, 2014.

*Primary Examiner* — Igor Kershteyn
*Assistant Examiner* — Christopher R Legendre
(74) *Attorney, Agent, or Firm* — Global IP Counselors, LLP

(57) ABSTRACT

An axially split pump for a fluid includes an axially split housing with a bottom and a cover, a rotatable shaft, and a side cover. The side cover has a first surface for cooperating with a second surface. The second surface extends over the bottom and the cover. The bottom has a first sealing surface and the cover has a second sealing surface. The bottom and the cover can be fastened so that the sealing surfaces are in direct contact. One sealing groove is in one of the sealing surfaces for the reception of a string-like sealing element, the sealing groove extending up to the second surface. A recess surrounding the shaft is in the second surface and a projection surrounding the shaft is in the first surface. The recess and the projection are arranged so that they form a ring-like groove for the reception of a ring-like sealing element.

19 Claims, 6 Drawing Sheets

(51) Int. Cl.

| | |
|---|---|
| ***F04D 29/043*** | (2006.01) |
| ***F04D 29/053*** | (2006.01) |
| ***F04D 29/12*** | (2006.01) |
| ***F04D 29/22*** | (2006.01) |
| ***F04D 29/28*** | (2006.01) |
| ***F04D 29/42*** | (2006.01) |
| ***F04D 29/62*** | (2006.01) |
| ***F04D 29/08*** | (2006.01) |

(52) U.S. Cl.
CPC ..... *F04D 29/053* (2013.01); *F04D 29/086* (2013.01); *F04D 29/122* (2013.01); *F04D 29/22* (2013.01); *F04D 29/28* (2013.01); *F04D 29/426* (2013.01); *F04D 29/4206* (2013.01); *F04D 29/624* (2013.01); *F04D 29/628* (2013.01)

(58) Field of Classification Search
CPC .... F04D 29/406; F04D 29/42; F04D 29/4206; F04D 29/4213; F04D 29/426; F04D 29/52; F04D 29/522; F04D 29/528; F16J 15/06
See application file for complete search history.

(56) References Cited

U.S. PATENT DOCUMENTS

2007/0172367 A1* 7/2007 Janocko ..... F04D 15/00 417/423.11
2011/0024987 A1* 2/2011 Crowley ..... F16J 15/3416 277/306
2011/0250059 A1* 10/2011 Reischmann ..... F04D 29/126 415/203
2014/0112808 A1* 4/2014 Moore ..... F04D 3/00 417/423.7
2014/0178182 A1* 6/2014 Huth ..... F04D 29/083 415/170.1
2015/0300365 A1* 10/2015 Montemayor ..... F16J 15/062 415/214.1
2015/0345503 A1* 12/2015 Del Vescovo ..... F01D 25/243 415/214.1
2016/0160870 A1* 6/2016 Welschinger ..... F04D 29/083 415/214.1
2016/0160871 A1* 6/2016 Welschinger ..... F04D 29/083 415/214.1
2016/0160873 A1* 6/2016 Handloser ..... F04D 29/22 415/214.1

FOREIGN PATENT DOCUMENTS

| | | | |
|---|---|---|---|
| EP | 0491984 | A1 | 7/1992 |
| EP | 2636905 | A1 | 9/2013 |
| JP | 6224079 | Y2 | 6/1987 |
| WO | 2014083374 | A1 | 6/2014 |
| WO | 2014095787 | A1 | 6/2014 |

* cited by examiner

AXIALLY SPLIT PUMP

CROSS-REFERENCE TO RELATED APPLICATIONS

This application claims priority to EP Application No. 14196438.7, filed Dec. 5, 2014, the contents of which is hereby incorporated herein by reference.

BACKGROUND

Field of Invention

The invention relates to an axially split pump for conveying a fluid.

Background Information

Axially split pumps, which are also referred to as horizontally divided pumps, are pumps in which the housing is divided in parallel with the axis of the shaft and that has a bottom part and a cover. Both the bottom part as well as the cover each have a flange which are placed on top of one another for a mounting of the pump and are then fixedly connected to one another, for example are screwed to one another.

Axially split pumps have been known for a long time and are produced in a variety of embodiments, typically as centrifugal pumps, for example as single flow or dual flow pumps and as single stage or multi-stage pumps. In this connection the impeller of the pump can be arranged between two bearings (between bearing pump). Also the field of application of these pumps is very wide, for example, they are used in the oil and gas industry or in the water industry or in the field of generation of energy. Frequently axially split pumps are configured for a high operating pressure or for large volume flows and are suitable for pumping over large geodetic heights, for the conveyance through water pipelines or oil pipelines or for the desalination of sea water by means of reverse osmosis.

Naturally the seal between the bottom part and the cover of the housing along the two flanges is of great importance having regard to axially split pumps. Likewise a very good seal has to be achieved between the housing and the side covers which close the pump in the axial direction.

For sealing between the bottom part and the cover it is known to insert a flat seal between the two flanges, in particular for applications with high pressure, such that the two flanges do not directly contact one another in the mounted state, but rather contact the flat seal at both sides. Such flat seals require a high pre-load, in particular also in order to achieve the required aerial pressing between the bottom part, the cover and the flat seal.

An alternative technology for sealing between the bottom part and the cover, as is, for example, also described in the WO-A-2014/083374, consists therein of mounting the flanges of the bottom part and the upper part directly on top of one another without a seal lying there between. The respective surfaces of the two flanges then form sealing surfaces that, in the mounted state, have a direct contact with one another. Having regard to this solution a sealing groove is provided in the bottom part or in the cover or in the bottom part and in the cover, the sealing groove extending over the complete axial length of the pump and into which a string-like sealing element, for example, an O-ring-like sealing element is inserted. Frequently, the sealing groove is only provided in the bottom part for reasons of manufacture and mounting. After insertion of the string-like sealing element into the sealing groove, the bottom part and the cover are fixedly screwed to one another such that the sealing surfaces of the two flanges are in direct contact with one another and the string-like sealing element is elastically deformed in the sealing groove, in order to ensure a reliable seal.

SUMMARY

As no flat seal is inserted between the flange of the bottom part and that of the cover having regard to this solution, the screws, by means of which the bottom part and the cover are fastened to one another, have to bear a significantly reduced load. From this a few advantages results: for example, the flanges which form the sealing surfaces can be configured considerably thinner and narrower, less material is required for the flanges which brings about a cost and weight saving; smaller screws and/or bolts can be used for the screwing together of the bottom part and the cover for this reason these can also be placed closer to the hydraulic contour. Moreover, the use of the string-like sealing element permits a larger deformation of the housing in comparison to the flat seals. This is in particular of advantage having regard to multi-stage pumps, as the leakage between different pressure spaces in the pump in which different pressures are present can be significantly reduced or can even be avoided.

The string-like sealing elements are typically manufactured from an elastomer, such as are also used for common O-ring seals, for example from a nitrile rubber or a nitrile butadiene rubber (NBR).

For most applications it has been proven to be of advantage to provide more than one sealing groove each having one inserted string-like sealing element. Thus, for example, an inner string-like sealing element can be provided for the seal of the suction space with regard to the pressure space and an outer string-like sealing element which seals the inner space of the pump with respect to the outside world, this means with regard to the environmental pressure. In particular having regard to multi-stage pumps additional sealing grooves can be provided with a respectively inserted string-like element in order to bound the different pressure spaces in which different pressures are present with respect to one another.

Having regard to the design of such seals by means of string-like sealing elements one strives to design the individual string-like sealing elements, if possible, as closed, this means in particular as ring-like sealing elements, as the connection or contact points between individual string-like sealing elements can potentially lead to leaks, in particular then when the pump is designed for a high operating pressure of, for example up to 100 bar. However, from a pure construction point of view it is not possible to exclusively make provision for sealing strings closed with respect to one another. Critical points will always arise at which two individual sealing elements have to bound one another and which have to cooperate with one another for the desired seal.

Such a critical point is the connection between the housing of the pump and the side covers of the pump, a point at which a total of three components bound one another, namely the bottom part of the housing, the cover of the housing and the side cover. At this critical point the pump has to be sealed with respect to the environment and/or the environmental pressure. Leaks present here not only lead to a reduction of the efficiency of the pump but rather, depending on the fluid conveyed by the pump, can also lead to pollutions of the environment by escaping fluid, for example having regard to liquids such as fossil oil or crude oil.

Starting from the described state of the art it is thus an object of the invention to suggest an axially split pump for the conveying of a fluid in which a reliable and high pressure resistant seal is provided between the housing of the pump and the side cover.

The subject matter of the invention satisfying this object.

In accordance with the invention an axially split pump for conveying a fluid is thus suggested having an axially split housing that comprises a bottom part and a cover, having a rotatable shaft that determines an axial direction, as well as having at least one side cover for closing the housing in the axial direction, wherein the side cover has a first contact surface for cooperating with a second contact surface provided at the housing, the second contact surface extending both over the bottom part and the cover, wherein the bottom part has a first sealing surface and the cover has a second sealing surface, wherein the bottom part and the cover can be fastened to one another in such a way that the two sealing surfaces have a direct contact with one another, wherein at least one sealing groove for the reception of a string-like sealing element is provided in one of the sealing surfaces, the sealing groove extending up to the second contact surface of the housing, wherein a recess surrounding the shaft is provided in the second contact surface and wherein a projection surrounding the shaft is provided in the first contact surface of the side cover, wherein the recess and the projection are configured and arranged in such a way that they together form a ring-like groove for the reception of a ring-like sealing element in the mounted state of the side cover.

Preferably a string-like sealing element is in this connection inserted into the sealing groove and a ring-like sealing element is inserted into the ring-like sealing groove.

The invention is based on the recognition that in particular at such contact points between two separate sealing elements, at which a planar—this means a non-curved—end surface of the one sealing element contacts a curved surface, for example the jacket surface, of a second sealing element circular in cross-section. This geometry brings about a reduced contact surface between the two sealing elements such that leaks can arise here in a simplified manner.

Due to the fact that the ring-like groove for the reception of the ring-like sealing element is formed together by the housing and the side cover in accordance with the invention, additional sealing positions arise at this critical point by means of which the effect of the sealing elements is improved such that, also in particular for very high operating pressures, an extremely reliable seal is ensured between the housing of the pump and the side cover.

From a construction point of view such a design is preferred in which the string-like sealing elements has a planar cross-sectional surface at the second contact surface.

Having regard to a good sealing effect it is an advantageous measure when the sealing groove opens substantially perpendicular into the ring-like groove.

In accordance with a preferred embodiment the sealing groove is provided in the bottom part of the housing which in particular enables a more simple manufacture and a more simple mounting.

Furthermore, such a design is preferred in which the sealing groove extends from the second contact surface up to the end of the pump disposed opposite with respect to the axial direction, which end is configured for the reception of a second side cover that is suitable for closing the housing and in which the string-like sealing element is inserted into the sealing groove, the string-like sealing element extending over the total longitudinal extent of the sealing groove. Hereby a continuous sealing element—this means a sealing element not separated by connections—is ensured between the bottom part and the cover of the housing along the total axial length of the pump. Naturally, this continuous sealing groove is generally not of straight line design but in a suitable way follows the inner contour in the pump.

From a construction point of view it is an advantageous measure when the ring-like groove formed by the recess and the projection has a substantially rectangular cross-sectional surface perpendicular to its longitudinal extent.

Having regard to a good sealing effect it is preferred when the ring-like groove has a width in the radial direction that is larger than the width of the string-like sealing element.

Having regard to the ring-like sealing element it is preferred when a ring-like sealing element is inserted into the ring-like groove that preferably has a circular or elliptical cross-sectional surface.

It is particularly advantageous when the ring-like sealing element has a height in the axial direction that is larger than the depth of the ring-like groove in the axial direction. Thereby the ring-like sealing element projects beyond the ring-like groove with respect to the axial direction in the un-mounted state and is then compressed on the mounting by elastic deformation against the end surface of the string-like sealing element such that a more intimate contact between the two sealing elements is ensured.

A further advantageous measure consists therein that the sealing groove has a cut-out at its opening into the second contact surface which is arranged lying radially inward with respect to the sealing groove.

Optionally an elastic pre-loading element can then be inserted into this cut-out which exerts a radially outwardly directed pre-load onto the string-like sealing element. This measure provides the advantage that a very good sealing effect is achieved from the start, already at lower operating pressures, this thus means for example on a start of the pump. Furthermore, the advantage results that following a longer operating duration of the pump, when degradations or other changes could arise in the string-like sealing element, the elastic preloading element compensates these changes and reliably presses the sealing element against the wall of the sealing groove.

Preferably the pre-loading element is spring elastic and extends in parallel with the string-like sealing element. Particularly preferably the pre-loading element is configured as a spring.

Having regard to the material it is preferred when the ring-like sealing element and the string-like sealing element are manufactured from an elastomer, in particular from a nitrile rubber, specifically from nitrile butadiene rubber (NBR).

The pump in accordance with the invention is in particular suitable also for very high operating pressures and can preferably be designed as a centrifugal pump having a design pressure of at least 50 bar, preferably of at least 100 bar.

Further advantageous measures and designs of the invention result from the dependent claims.

BRIEF DESCRIPTION OF THE DRAWINGS

The invention will be explained in more detail hereinafter with reference to the drawings.

DETAILED DESCRIPTION OF THE EMBODIMENTS

Figure 1:
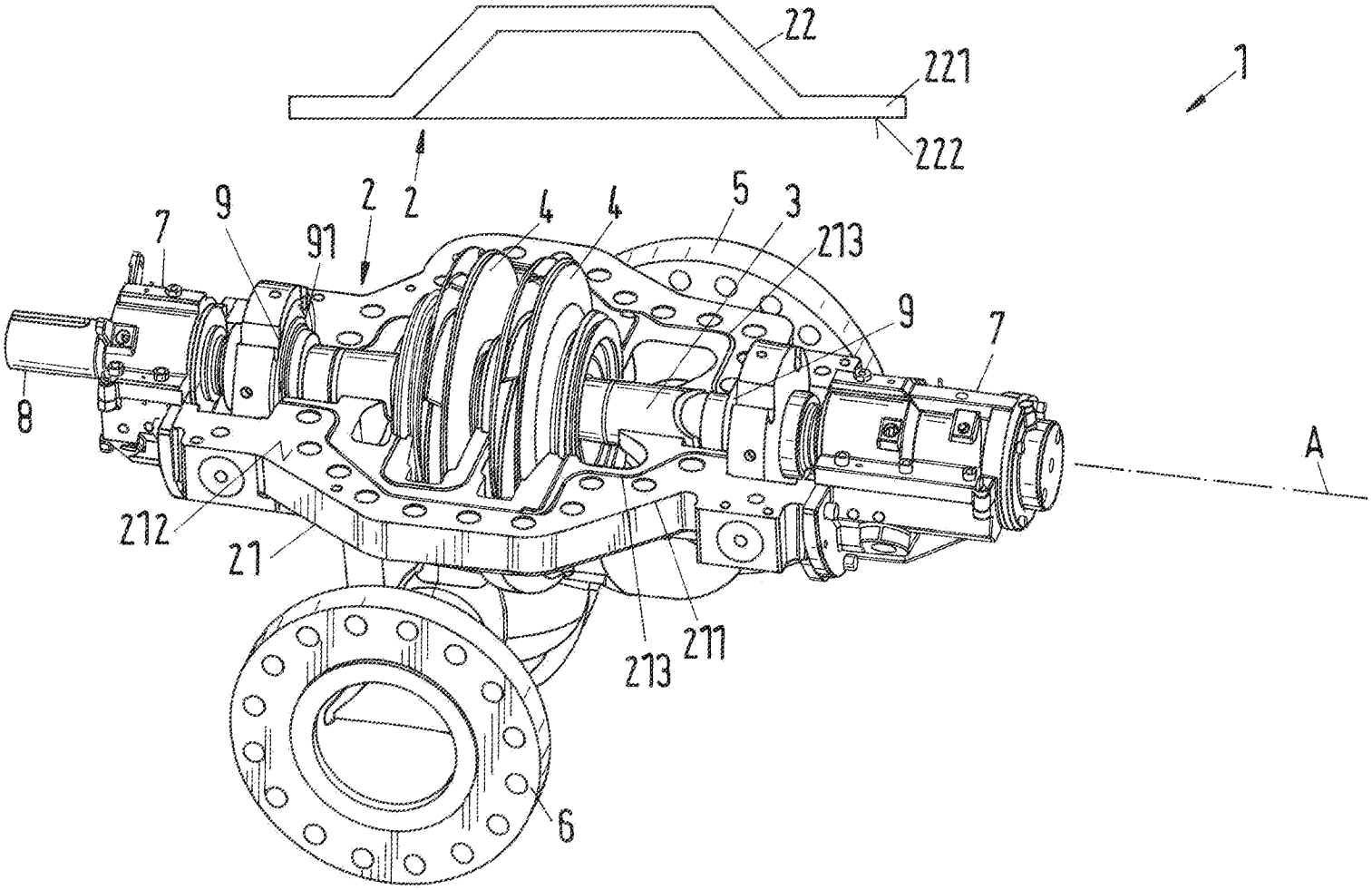
FIG. 1 is a perspective illustration of an embodiment of a pump in accordance with the invention, wherein the cover is removed and is only symbolically indicated.
Figure 2:
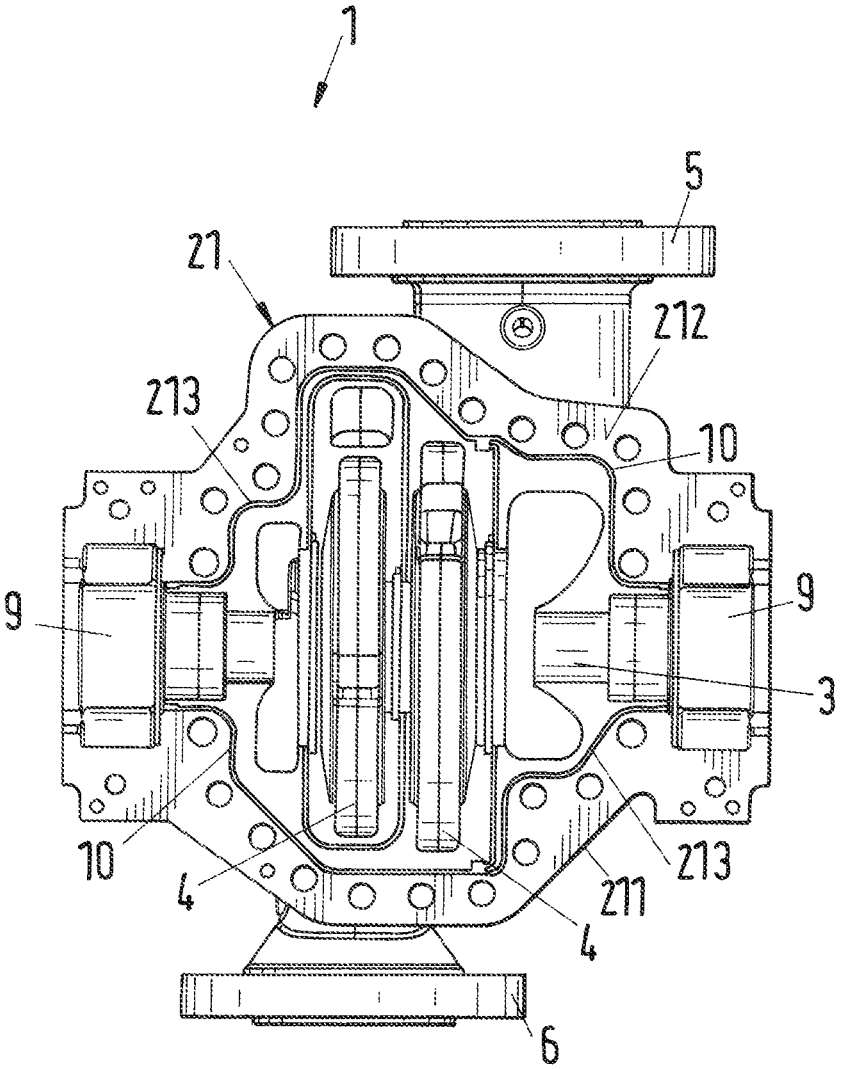
FIG. 2 is a top view onto the bottom part of the housing of the embodiment of FIG. 1.

FIG. 1 in a perspective illustration shows an embodiment of an axially split pump in accordance with the invention which is referred to in totality by means of the reference numeral 1. The pump 1 comprises a housing 2 that is axially split and that has a bottom part 21 as well as a cover 22. For a better understanding the cover 22 is removed in FIG. 1 and is only symbolically indicated. FIG. 2 shows a top view onto the bottom part 21 of the housing 2 of this embodiment.

The housing 2 comprise an inlet 5 for sucking in a fluid to be conveyed, as well as an outlet 6 for the fluid. The pump 1 further comprises a rotatable shaft 3 whose longitudinal direction determines an axial direction A. At least one impeller 4 is rotatably fixedly mounted at the shaft 3, in the present case two impellers 4 are mounted which convey the fluid from the inlet 5 to the outlet 6. Furthermore, a respective bearing apparatus 7 is provided at both ends with respect to the axial direction A of the pump 1 in order to support the shaft 3 of the pump 1. The left bearing apparatus 7 in accordance with the illustration (FIG. 1) is furthermore provided with a clutch 8 that can be connected to a non-illustrated drive which displaces the shaft 3 of the pump 1 into rotation.

The term axially split pump 1 and/or axially split housing 2 is meant as generally used such that the housing 2 is divided in parallel with the longitudinal direction of the shaft 3, this thus means in a plane which includes the longitudinal axis of the shaft 3.

In particular the pump 1 illustrated in FIGS. 1 and 2 is an axially split multi-stage centrifugal pump—in this example a two-stage centrifugal pump, that is of single flow design and is in a so-called between-bearing-arrangement, this means the impellers 4 are present between the bearing apparatuses 7. It is understood that the invention is not limited to such pump types, but rather is also suitable for other pumps with axially split housing 1, for example single stage pumps, this means such pumps having only one impeller 4, dual-flow pumps having a single stage or multi-stage design or different pump types in comparison to centrifugal pumps.

Having regard to the axial direction A the housing 2 of the pump 1 is respectively closed by a side cover 9 which in the present case simultaneously forms the closure cover of the mechanical shaft seal.

The cover 22 and the bottom part 21 of the housing 2 are in direct contact with one another in the mounted state, this means that no flat seal is provided between these two parts which would prevent the direct contact between the bottom part 21 and the cover 22. For this purpose the bottom part 21 comprises a first flange 211 which in the mounted state extends in the plane of the axial division of the housing 2 and its upper surface in accordance with the illustration forms a first sealing surface 212. In an analog-like manner the cover 22 is provided with a second flange 221 that extends in the mounted state in the plane of the axial division of the housing 2 and its lower surface in accordance with the illustration (FIG. 1) forms a second sealing surface 222.

Following the mounting of the cover 22 on the bottom part 21, the first sealing surface 212 and the second sealing surface 222 are in direct contact with one another in order to form a sealing connection between the bottom part 21 and the cover 22 of the housing 2. A sealing groove 213 is provided in the first sealing surface 212 of the bottom part 21, the sealing groove extending from the left side cover 9 in accordance with the illustration in the axial direction A following the inner contour of the pump 1 up to the other side cover 9. This sealing groove 213 is provided at both sides of the shaft 3. A string-like sealing element 10 is inserted into the sealing groove 213 which extends over the total length of the sealing groove 213 and which seals the inner space of the pump 1 with respect to the environment. The string-like sealing element 10 typically has a round cross-section, such as is, for example, known from common O-rings. Naturally it is also possible that the string-like sealing element has a different cross-section, for example, a rectangular and in particular a quadratic cross-section. In this connection the string-like sealing element 10 is dimensioned in such a way with respect to its diameter that it projects beyond the boundary of the sealing groove 213 in the un-mounted state. During the mounting of the cover 22 on the bottom part 21, the string-like sealing element 10 is thus elastically deformed and thus ensures a reliable seal between the bottom part 21 and the cover 22 of the housing 2.

The fastening of the cover 22 on the bottom part 21 preferably takes place by means of bolts or screws which engage through bores or threaded bores (without reference numerals in FIGS. 1 and 2) provided in the first sealing surface 212 in such a way that the bottom part 21 and the cover 22 are fixedly and sealingly screwed to one another.

Alternatively it is also possible to provide the sealing groove 213 in the cover 22 of the housing 2, or to provide a sealing groove both in the bottom part 21 as well as in the cover 22. For reasons of manufacture and mounting it is preferred to provide the sealing groove 213 and/or the sealing grooves only in the bottom part 21.

Figure 3:
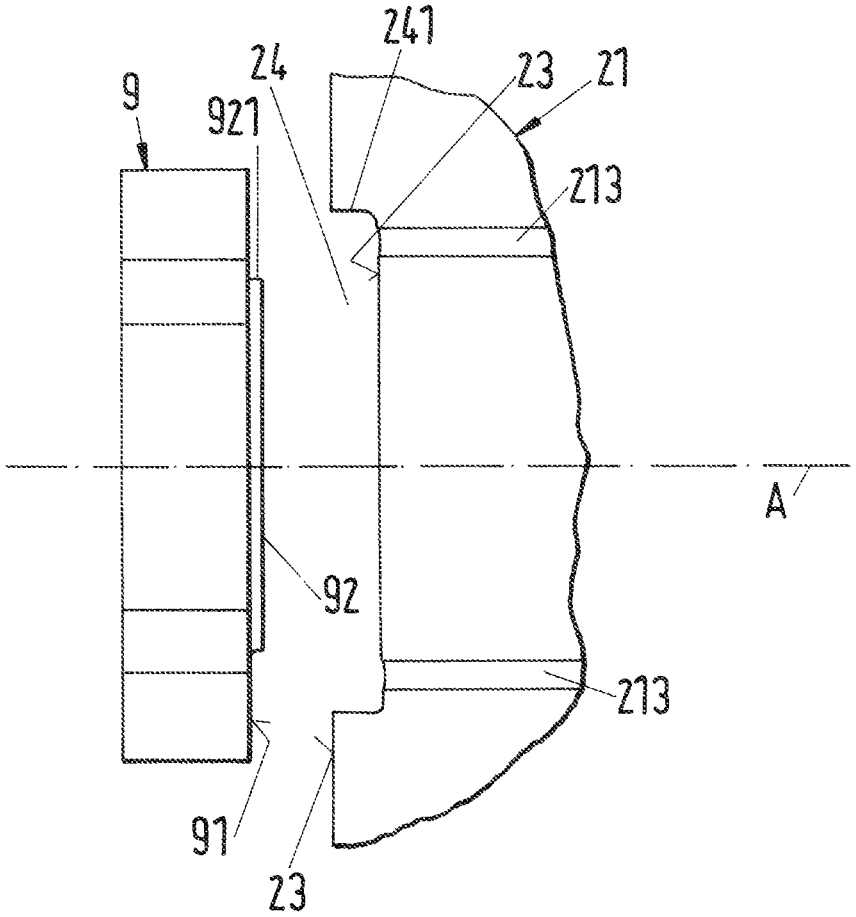
FIG. 3 is the side cover of the embodiment of FIG. 1, as well as a part of the housing.

In order to seal between the side cover 9 and the housing 2 the side cover 9 has a first contact surface 91 which cooperates with a second contact surface 23 that is provided at the housing 2 (see FIG. 3). The second contact surface 23 surrounds the shaft 3 and extends both over the bottom part 21 of the housing 2 as well as over the cover 22 of the housing 2. For a better understanding FIG. 3 in an enlarged illustration shows the side cover 9 and a part of the housing 2 in a top view onto the bottom part 21, wherein the side cover 9 has not yet been joined to the housing 2. One can also recognize the sealing groove 213 in the bottom part 21 of the housing 2 that extends up into the second contact surface 23 of the housing 2.

The sealing connection between the side cover 9 and the housing 2 represents a particular challenge as here three components bound one another, namely the side cover 9, the bottom part 21 and the cover 22 of the housing 2. The first contact surface 91 of the side cover 9 is formed by one of its bounding surfaces in the axial direction A. The second contact surface 23 of the housing 2 is perpendicular to the axial direction A in such a way that it is disposed opposite of the first contact surface 91.

In accordance with the invention a recess 24 is provided in the second contact surface 23 of the housing 2 which in this example is configured as a central cut-out in the second contact surface 23. Furthermore, a projection 92 is provided in the first contact surface 91 of the side cover 9. The projection in this example is configured as a central elevation. The recess 24 and the projection 92 are in this respect configured and arranged with respect to one another in such a way that they together form a ring-like groove 29 for the reception of a ring-like sealing element 11 (see also FIG. 4 and FIG. 5) in the mounted state of the side cover 9.

For this purpose the central cut-out which forms the recess 24 in the second contact surface 23 is configured with a substantially circular cross-section whose diameter is larger than that of the elevation configured likewise with a substantially circular cross-section, the elevation forming the projection 92 in the first contact surface 91 in the embodiment described in this example. Thereby the ring-like groove 29 formed together arises only after the joining of the side cover 9 and of the housing 2. This ring-like groove 29 is consequently radially outwardly limited by the sidewall 241 of the recess 24 in the second contact surface 23 of the housing 2 and radially inwardly by the lateral bounding surface 921 of the projection 92 in the first contact surface 91 of the side cover 9.

Figure 4:
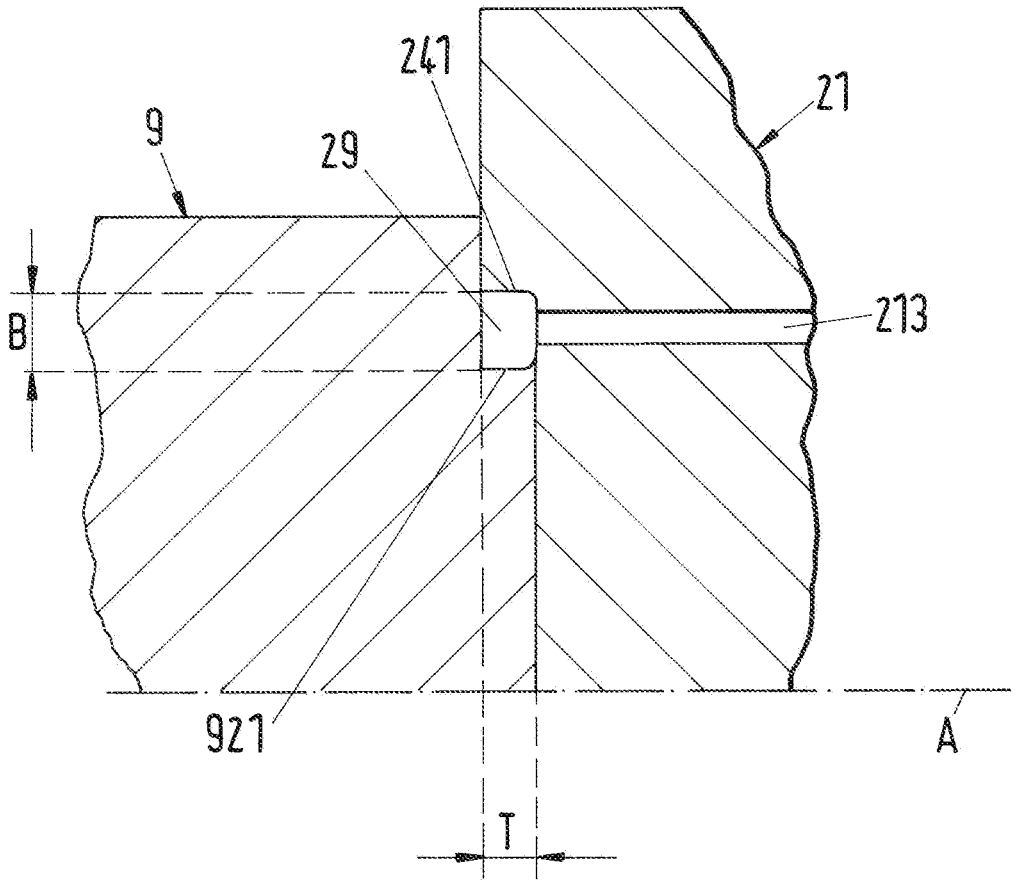
FIG. 4 is a schematic illustration of the side cover and of the housing of the embodiment of FIG. 1.

In a schematic illustration FIG. 4 shows the ring-like groove 29 which arises through the joining of the side cover 9 and of the housing 2. For reasons of better clarity the ring-like sealing element 11 and the string-like sealing element 10 are not illustrated in FIG. 4. Furthermore, FIG. 4 is limited to the illustration of the upper half of FIG. 3 as this is sufficient for the understanding.

Figure 5:
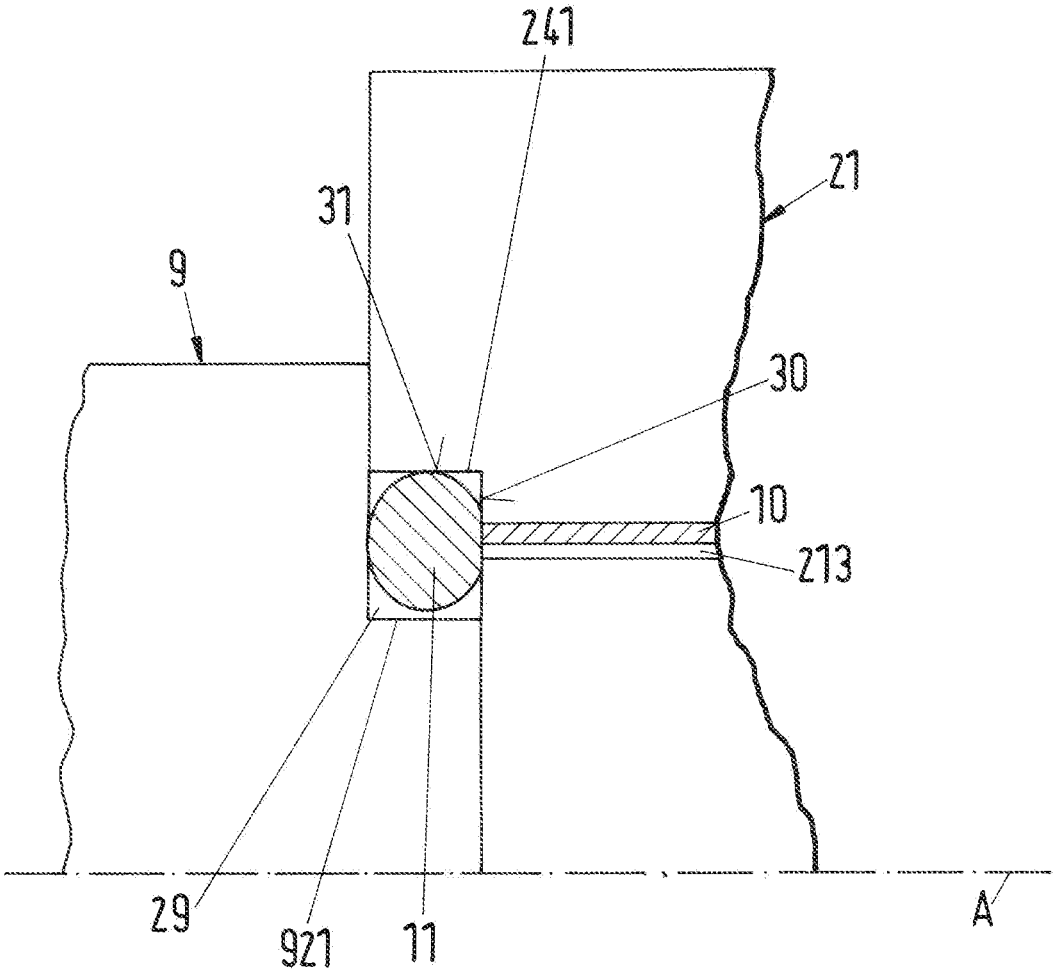
FIG. 5 is an analog to FIG. 4 but with inserted sealing elements.

FIG. 5 is an illustration similar to that shown in FIG. 4, however, the ring-like sealing element 11 is inserted into the ring-like groove 29 and the string-like sealing element 10 is inserted into the sealing groove 213 in this example.

Through the joining of the side cover 9 and of the housing 2, the ring-like groove 29 arises through the cooperation of the projection 92 in the side cover 9 and of the recess 24 in the housing 2, the ring-like groove surrounding the shaft 3 of the pump 1. The first contact surface 92 and the second contact surface 23 are in direct contact with one another after the mounting of the side cover within the region limited by the ring-like groove 29.

As is emphasized in particular in FIG. 4, the ring-like groove 29 has a substantially rectangular cross-sectional surface perpendicular to its longitudinal extent running in the circumferential direction. This cross-sectional surface is determined by the axial depth T of the ring-like groove 29—this means its depth with respect to the axial direction A—and by the radial width B of the ring-like groove 29—this means its width with respect to the axial direction A perpendicular to the radial direction.

As is likewise evident from FIG. 4 it is preferred that the sealing groove 213 opens substantially perpendicular into the ring-like groove 29. As the end surface of the string-like sealing element 10 placed at the second contact surface 23 preferably has a planar, this means non-curved, cross-sectional surface (see FIG. 5) an as good as possible contact between the string-like sealing element 10 and the ring-like sealing element 11 can be realized in the ring-like groove 29 by means of this measure.

It is also preferred when the radial width B of the ring-like groove 29 is larger than the width of the string-like sealing element 10. The sealing groove 213 is then arranged in such a way that it opens centrally into the ring-like groove 29.

The ring-like sealing element 11, which is inserted into the ring-like groove 29 preferably has a circular or elliptical a cross-sectional surface such that common sealing elements such as, for example O-rings, can be used in this context. Naturally it is also possible that the ring-like sealing element has a different cross-section, for example, a rectangular and in particular a quadratic cross-section. The ring-like sealing element 11 is preferably dimensioned in such a way that its height, this means its extent in the axial direction A, is larger than the axial depth T of the ring-like groove 29. Thus the ring-like sealing element 11 then namely projects beyond the projection 92 of the first contact surface 91 with respect to the axial direction A in the un-mounted state of the side cover 9. Having regard to the mounting of the side cover 9 at the housing 2, the ring-like sealing element is accordingly elastically deformed and as a consequence thereof is in intimate contact with the end surface of the string-like sealing element 10 (see FIG. 5). Having regard to the extent in the radial direction the ring-like sealing element 11 is preferably dimensioned in such a way that it fills the radial width B of the ring-like groove 29.

The string-like sealing element 10 is preferably likewise an O-ring-like element, however, it is not configured as a ring, but rather as a string having two ends and an for example round or circular cross-sectional surface perpendicular to its longitudinal extent. Having regard to the width in the radial direction the string-like sealing element 10 is typically dimensioned in such a way that it does not completely fill the sealing groove 213 as is illustrated in FIG. 5.

As a material both for the ring-like sealing element 11 as well as for the string-like sealing element 10 in particular all known materials are suitable that are used for such seals, in particular elastomers such as nitrile rubber and more specifically nitrile butadiene rubber (NBR) are suitable.

Having regard to the mounting of the pump 1, one proceeds, for example as follows: The string-like sealing element 10 is inserted into the sealing groove 213 provided for this purpose in the bottom part 21 of the housing 2 respectively at both sides of the shaft 3 (see e.g. FIG. 2), such that it extends from the second contact surface 23 of the housing 2 along the axial direction A following the inner contour of the pump 1 up to the oppositely disposed axial end of the pump 1. Subsequently, the cover 22 of the housing 2 can be connected to the bottom part 21, wherein the string-like sealing element 10 preferably elastically deforms in the sealing groove 213 and contributes to the seal between the bottom part 21 and the cover 22.

Prior to the mounting of the side cover 9, the ring-like sealing element 11 is placed around the projection 92 in the side cover 9. Following the mounting of the side cover 9 at the housing 2, the ring-like groove 29 then forms in which the ring-like sealing element 11 is inserted that presses against the end surface of the string-like sealing element 10 which is inserted into the sealing groove 213. This state is illustrated in FIG. 5.

The design in accordance with the invention having the ring-like groove 29 that is formed together by the projection 92 in the first contact surface 91 of the side cover 9 and by the recess 24 in the second contact surface 23 of the housing 2 in a very advantageous manner combines the effect of a predominantly axial seal with those of a predominantly radial seal.

As is shown in FIG. 5 additional axial sealing surfaces 30 and additional radial sealing surfaces 31 arise which contribute to an improved seal between the housing 2 and the side cover 9 by means of the common ring-like groove 29, whose one wall is formed by the sidewall 241 of the recesses 24, whereas the other wall is formed by the lateral bounding surface 921 of the projection 92.

This improved sealing effect is in particular advantageous also having regard to an as high as possible operating pressure of the pump 1. Thus, the pump 1 can, for example be designed in one embodiment as a centrifugal pump having a design pressure of at least 50 bar and preferably of at least 100 bar.

Figure 6:
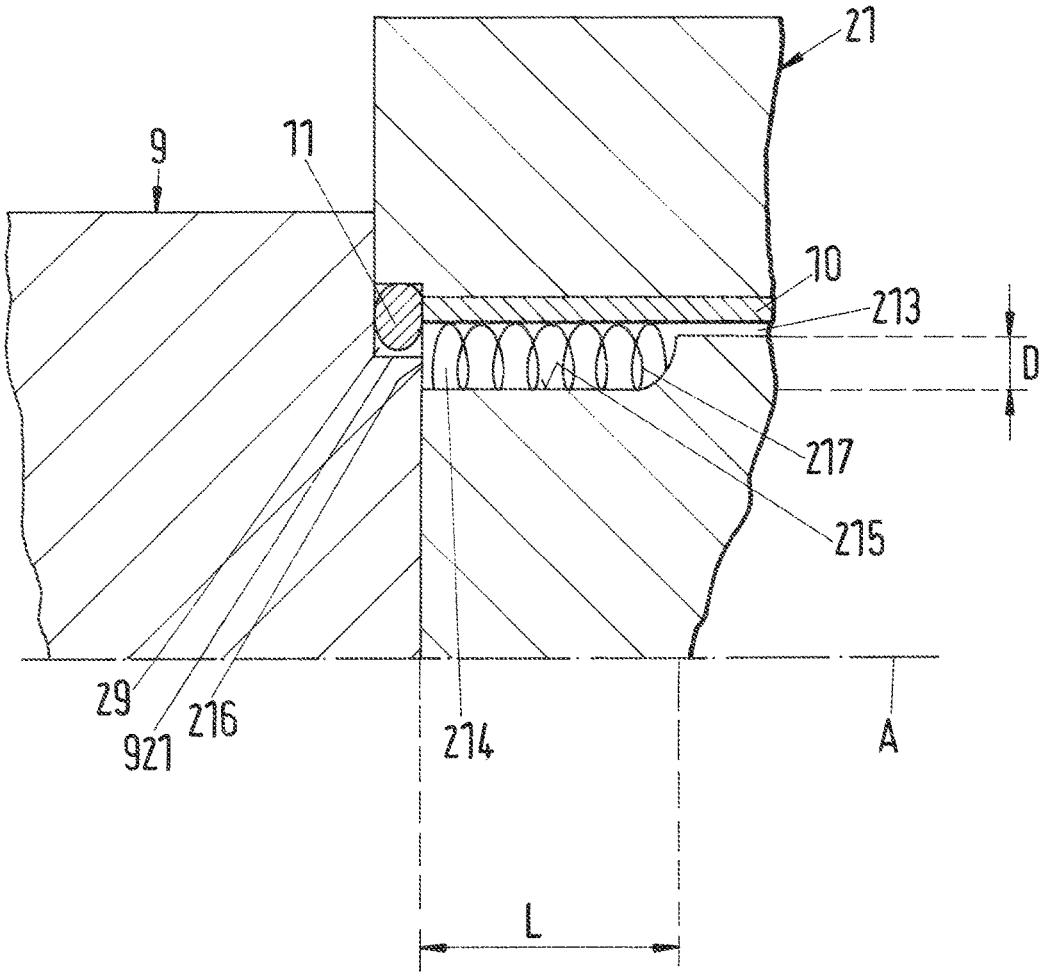
FIG. 6 is a variant for the embodiment in an analog illustration with respect to FIG. 5.

FIG. 6 emphasizes in an illustration analog to that of FIG. 5 a particularly preferred variant for the design of the pump 1 in accordance with the invention. In the following reference will only be made to the differences to the described embodiment. Otherwise the previously made explanations are true in a like or analog-like manner also for this variant. In particular the reference numerals have the same meaning for like parts or parts having a like function.

Having regard to the variant illustrated in FIG. 6 the sealing groove 213 has a cut-out 214 at its opening into the second contact surface 23 and/or into the ring-like groove 29, the recess being arranged lying radially inward with respect to the sealing groove 213 over a length L. The cut-out 214 extends in parallel with the sealing groove 213 in such a way that the sealing groove 213 in its end region in the axial direction A over a length L has a larger extent in the radial direction by the width D of the cut-out 214. As is shown in FIG. 6 the radially inwardly lying bounding surface 215 of the cut-out 214 is arranged in such a way that it lies closer to the shaft 3 than the lateral bounding surface 921 of the projection 92. Thereby a section 216 exists between the lateral bounding surface 921 of the projection 92 and the bounding surface 215 of the cut-out 214 arranged lying radially inward with respect to this, the section being a part of the first contact surface 91 of the side cover 9.

An elastic pre-loading element 217 is preferably inserted into the cut-out 214 which exerts a radially outwardly directed pre-load onto the string-like sealing element 10. Preferably the pre-loading element 217 is spring elastic and in particular configured preferably as a spring. The spring 217 extends in parallel with the string-like sealing element 10 and is dimensioned in such a way that it is wider than the width D of the cut-out 214 with respect to the radial direction. After the mounting of the side cover 9, the spring 217 can be supported at the section 216.

The variant having the pre-loading element 217 provides several advantages. During the operation of the pump 1, the pre-loading element ensures an additional contribution such that also for smaller operating pressures, this means, for example on a start of the pump 1, a sufficient sealing effect is realized straight away between the housing 2 and the side cover 9. Also having regard to the long term operation of the pump 1 the pre-loading element 217 is advantageous. If namely degradations, fatigue or other changes or appearances of wear of the string-like sealing element 10 are brought about with an increase in the operating duration of the pump 1, then these can be compensated by means of the effect of the pre-loading element 217, as this reliably presses the string-like sealing element 10 against the wall of the sealing groove 213 lying radially outward.

It can be advantageous as a further additional measure, in particular having regard to very high operating pressures of the pump, to apply a thin liquid seal in the region of the common ring-like groove 29 at the first or the second sealing surface 212 and/or 222 of the bottom part 21 and/or of the cover 22 prior to the connection of the cover 22 to the bottom part 21, this thus means to apply a fluid that amplifies the sealing effect between the two sealing surfaces 212 and 222.

It is naturally understood that the seal of the second side cover or of further side covers with respect to the housing 2 preferably takes place in a like or analog-like manner as described in the foregoing even if the invention is only explained with reference to one of the two side covers 9.

The invention claimed is:

1. An axially split pump for conveying a fluid, comprising:

an axially split housing including a bottom part and a cover;

a rotatable shaft determining an axial direction; and at least one side cover configured to close the housing in the axial direction, the at least one side cover having a first contact surface configured to cooperate with a second contact surface disposed on the housing, the second contact surface extending along both the bottom part and the cover, the bottom part having a first sealing surface and the cover having a second sealing surface, the bottom part and the cover being configured to be fastened to one another so that the first and second sealing surfaces are in direct contact with one another, at least one sealing groove disposed in one of the first and second sealing surfaces for the reception of a string-like sealing element, the at least one sealing groove extending up to the second contact surface of the housing, a recess surrounding the shaft being disposed in the second contact surface and a projection surrounding the shaft being disposed in the first contact surface of the at least one side cover, and the recess and the projection being configured and arranged so as to form a ring-shaped groove for the reception of a ring-shaped sealing element in a mounted state of the at least one side cover.

2. A pump in accordance with claim 1, wherein the string-like sealing element is inserted into the at least one sealing groove and the ring-shaped sealing element is inserted into the ring-shaped groove.

3. A pump in accordance with claim 1, in which the string-like sealing element has a planar surface at the second contact surface.

4. A pump in accordance with claim 1, wherein the at least one sealing groove opens substantially perpendicularly into the ring-shaped groove.

5. A pump in accordance with claim 1, wherein the at least one sealing groove is disposed in the bottom part of the housing.

6. A pump in accordance with claim 1, wherein the at least one side cover includes a first side cover and a second side cover, the at least one sealing groove extends from the second contact surface at one end of the pump up to an other end of the pump disposed opposite to the one end with respect to the axial direction, the other end being configured to receive the second side cover configured to close the housing, and in which the string-like sealing element is inserted into the at least one sealing groove, the string-like sealing element extending over a total longitudinal extent of the at least one sealing groove.

7. A pump in accordance with claim 1, wherein the projection has a substantially rectangular cross-sectional surface perpendicular to a longitudinal extent thereof.

8. A pump in accordance with claim 1, wherein the ring-shaped groove has a width (B) in a radial direction that is larger than a width of the string-like sealing element.

9. A pump in accordance with claim 1, wherein the ring-shaped sealing element has a circular or elliptical cross-sectional configuration.

10. A pump in accordance with claim 1, wherein the ring-shaped sealing element has a height that is larger than a depth of the ring-shaped groove when the ring-shaped sealing element is not installed in the ring-shaped groove.

11. A pump in accordance with claim 1, wherein the at least one sealing groove has a cut-out at an opening into the second contact surface, the cut-out being arranged lying radially inward with respect to the at least one sealing groove.

12. A pump in accordance with claim 11, further comprising an elastic pre-loading element inserted into the cut-out, the elastic pre-loading element exerting a radially outwardly directed pre-load on the string-like sealing element.

13. A pump in accordance with claim 12, wherein the elastic pre-loading element is spring elastic and extends in parallel with the string-like sealing element.

14. A pump in accordance with claim 1, configured as a centrifugal pump having a design pressure of at least 50 bar.

15. A pump in accordance with claim 13, wherein the elastic pre-loading element is a spring.

16. A pump in accordance with claim 1, wherein the ring-shaped sealing element and the string-like sealing element are an elastomer.

17. A pump in accordance with claim 1, wherein the ring-shaped sealing element and the string-like sealing element are a nitrile rubber.

18. A pump in accordance with claim 1, wherein the ring-shaped sealing element and the string-like sealing element are a nitrile butadiene rubber (NBR).

19. A pump in accordance with claim 1 configured as a centrifugal pump having a design pressure of at least 100 bar.

* * * * *